US008440929B2

(12) United States Patent
Rosenkrans et al.

(10) Patent No.: US 8,440,929 B2
(45) Date of Patent: May 14, 2013

(54) VACUUM SWITCH INCLUDING AN INSULATING BODY HAVING A NUMBER OF TRANSPARENT PORTIONS MADE OF A SINGLE CRYSTAL ALUMINA

(75) Inventors: Benjamin A. Rosenkrans, Painted Post, NY (US); Wangpei Li, Horseheads, NY (US)

(73) Assignee: Eaton Corporation, Cleveland, OH (US)

( * ) Notice: Subject to any disclaimer, the term of this patent is extended or adjusted under 35 U.S.C. 154(b) by 185 days.

(21) Appl. No.: 13/195,070

(22) Filed: Aug. 1, 2011

(65) Prior Publication Data

US 2013/0032576 A1 Feb. 7, 2013

(51) Int. Cl.
*H01H 33/26* (2006.01)

(52) U.S. Cl.
USPC ..... 218/119; 218/147; 200/51 R; 200/144 B

(58) Field of Classification Search ..... 218/119, 218/139, 147; 200/51 R, 144 B
See application file for complete search history.

(56) References Cited

U.S. PATENT DOCUMENTS

| | | | | |
|---|---|---|---|---|
| 3,801,184 | A | 4/1974 | Merz et al. | |
| 3,942,132 | A | 3/1976 | Zinn | |
| 4,234,771 | A * | 11/1980 | Ohkawa et al. | 218/139 |
| 4,249,050 | A | 2/1981 | Okumura | |
| 4,281,228 | A * | 7/1981 | Harmon | 200/51 R |
| 4,408,107 | A | 10/1983 | Sakuma et al. | |
| 5,286,933 | A * | 2/1994 | Pham | 218/119 |
| 7,301,149 | B2 | 11/2007 | Mackin et al. | |
| 7,497,122 | B2 * | 3/2009 | Montesclaros et al. | 73/700 |
| 2007/0278187 | A1 | 12/2007 | Siebens et al. | |
| 2007/0295694 | A1 | 12/2007 | Lindner et al. | |

FOREIGN PATENT DOCUMENTS

| | | | |
|---|---|---|---|
| GB | 832 251 | A | 4/1960 |
| JP | 2005 329330 | A | 12/2005 |

OTHER PUBLICATIONS

European Patent Office, "International Search Report and Written Opinion", Sep. 13, 2012, 9 pp.

* cited by examiner

*Primary Examiner* — Truc Nguyen
(74) *Attorney, Agent, or Firm* — Eckert Seamans Cherin & Mellott, LLC; Kirk D. Houser

(57) ABSTRACT

A vacuum switch includes a vacuum envelope; a fixed contact assembly partially within the vacuum envelope; and a movable contact assembly partially within the vacuum envelope and movable between a closed position in electrical contact with the fixed contact assembly and an open position spaced apart from the fixed contact assembly. The vacuum envelope includes an insulating body having a number of transparent portions made of a single crystal alumina for viewing the fixed contact assembly and the movable contact assembly within the vacuum envelope.

15 Claims, 5 Drawing Sheets

VACUUM SWITCH INCLUDING AN INSULATING BODY HAVING A NUMBER OF TRANSPARENT PORTIONS MADE OF A SINGLE CRYSTAL ALUMINA

BACKGROUND

1. Field

The disclosed concept pertains to vacuum switching apparatus such as, for example, vacuum switches including a vacuum envelope such as, for example, vacuum interrupters.

2. Background Information

Vacuum interrupters include separable main contacts disposed within an insulated and hermetically sealed vacuum chamber. The vacuum chamber typically includes, for example and without limitation, a number of sections of ceramics (e.g., without limitation, a number of tubular ceramic portions) for electrical insulation capped by a number of end members (e.g., without limitation, metal components, such as metal end plates; end caps; seal cups) to form an envelope in which a partial vacuum may be drawn. The example ceramic section is typically cylindrical; however, other suitable cross-sectional shapes may be used. Two end members are typically employed. Where there are multiple ceramic sections, an internal center shield may be disposed between the example ceramic sections.

Typically, the number of sections of ceramics for electrical insulation are a number of solid opaque structures.

U.S. Pat. No. 4,408,107 discloses a vacuum envelope including a housing made of non-magnetic metallic material with end plates fabricated from insulating material in the form of a ceramic or crystallized glass.

U.S. Pat. No. 4,249,050 discloses a vacuum switch comprising a vacuum vessel defined by an insulating cylinder, which is preferably made of a transparent material such as glass, and end plates. A cylindrical member may be constructed by a metal cylinder which is provided with a glass window at a portion corresponding to a gap between shields to permit direct observation of the interior of the vacuum vessel.

U.S. Patent Application Pub. No. 2007/0278187 discloses a vacuum bottle attached to a housing to form a switch or interrupter assembly. The vacuum bottle contains a contact. An actuating element connects to an actuating mechanism for either a switch or interrupter. An indicator for the contact is attached to an insulated rod of the actuating mechanism. The indicator has a red portion (for indicating the contact is closed) and a green portion (for indicating the contact is open). A viewing window extends through the housing so that, when the actuating mechanism opens or closes the contact, the red portion or green portion of the indicator is aligned with the viewing window and shows the position of the contact.

U.S. Patent Application Pub. No. 2007/0295694 discloses a vacuum bottle with a viewing window that is mounted in series with a circuit breaker within a porcelain casing. A rigid tube and an elastomer casing are arranged to define an observation window that is at least translucent, and through which the open or closed position of switch contacts can be seen. The rigid tube is made by molding a plastics material that is transparent or at least translucent. The plastics material may be a transparent thermoplastic polymer such as safety glass.

There is room for improvement in electrical switching apparatus, such as vacuum switches.

There is also room for improvement in vacuum interrupters.

SUMMARY

These needs and others are met by embodiments of the disclosed concept in which a vacuum switch comprises a number of transparent portions such as, for example and without limitation, window(s), region(s), body or bodies present in an insulating body. As a result, all of the insulating body or a portion of the insulating body is made from a transparent material made of a single crystal alumina ($Al_2O_3$) for viewing a fixed contact assembly and a movable contact assembly within a vacuum envelope.

In accordance with embodiments of the disclosed concept, a vacuum switch comprises: a vacuum envelope; a fixed contact assembly partially within the vacuum envelope; and a movable contact assembly partially within the vacuum envelope and movable between a closed position in electrical contact with the fixed contact assembly and an open position spaced apart from the fixed contact assembly; wherein the vacuum envelope comprises an insulating body comprising a number of transparent portions made of a single crystal alumina ($Al_2O_3$) for viewing the fixed contact assembly and the movable contact assembly within the vacuum envelope.

The number of transparent portions may be a number of sapphire members.

The insulating body may further comprise a number of openings; and each of the number of sapphire members may be brazed to the insulating body at a corresponding one of the number of openings.

The insulating body may be made of the single crystal alumina ($Al_2O_3$); and the number of transparent portions may be all of the insulating body.

The insulating body may be in the form of a solid cylinder made of the single crystal alumina ($Al_2O_3$).

The number of transparent portions may be a number of transparent windows.

The number of transparent portions may be a number of transparent regions.

The number of transparent portions may be all of the insulating body.

The insulating body may further comprise a number of openings; and each of the number of transparent portions may be brazed to the insulating body at a corresponding one of the number of openings.

The insulating body may be metalized at a number of edges; each of the number of edges may be defined by a corresponding one of the number of openings; each of the number of transparent portions may be metalized at a peripheral edge corresponding to one of the metalized number of edges of the insulating body; and the metalized peripheral edge may be brazed to a corresponding one of the metalized number of edges of the insulating body.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "vacuum envelope" means an envelope employing a partial vacuum therein.

As employed herein, the term "partial vacuum" means a space (e.g., within a vacuum envelope) partially exhausted (e.g., to the highest degree practicable; to a relatively high degree; to a degree suitable for use in a vacuum switching apparatus application) by a suitable mechanism (e.g., without limitation, an air pump; a vacuum furnace).

The disclosed concept is described in association with vacuum interrupters, although the disclosed concept is applicable to a wide range of vacuum switches.

The disclosed concept enables the separable contacts of a vacuum interrupter to be seen in an open or closed position by employing a number of transparent portions as part of or as an insulating body.

Although glass windows are known, glass is not as robust as ceramic, polycrystalline alumina, single crystal alumina or sapphire, and will break easier. Over time, because glass is not as dense as ceramic, polycrystalline alumina, single crystal alumina or sapphire, the glass will allow hydrogen to permeate through the glass and cause a vacuum switch to lose the quality of its partial vacuum. Ceramic, polycrystalline alumina, single crystal alumina or sapphire provide a good quality partial vacuum virtually forever. Also, attaching glass to ceramic will present problems since the dielectric strength of glass is not as good as the dielectric strength of ceramic, polycrystalline alumina, single crystal alumina or sapphire.

Figure 1:
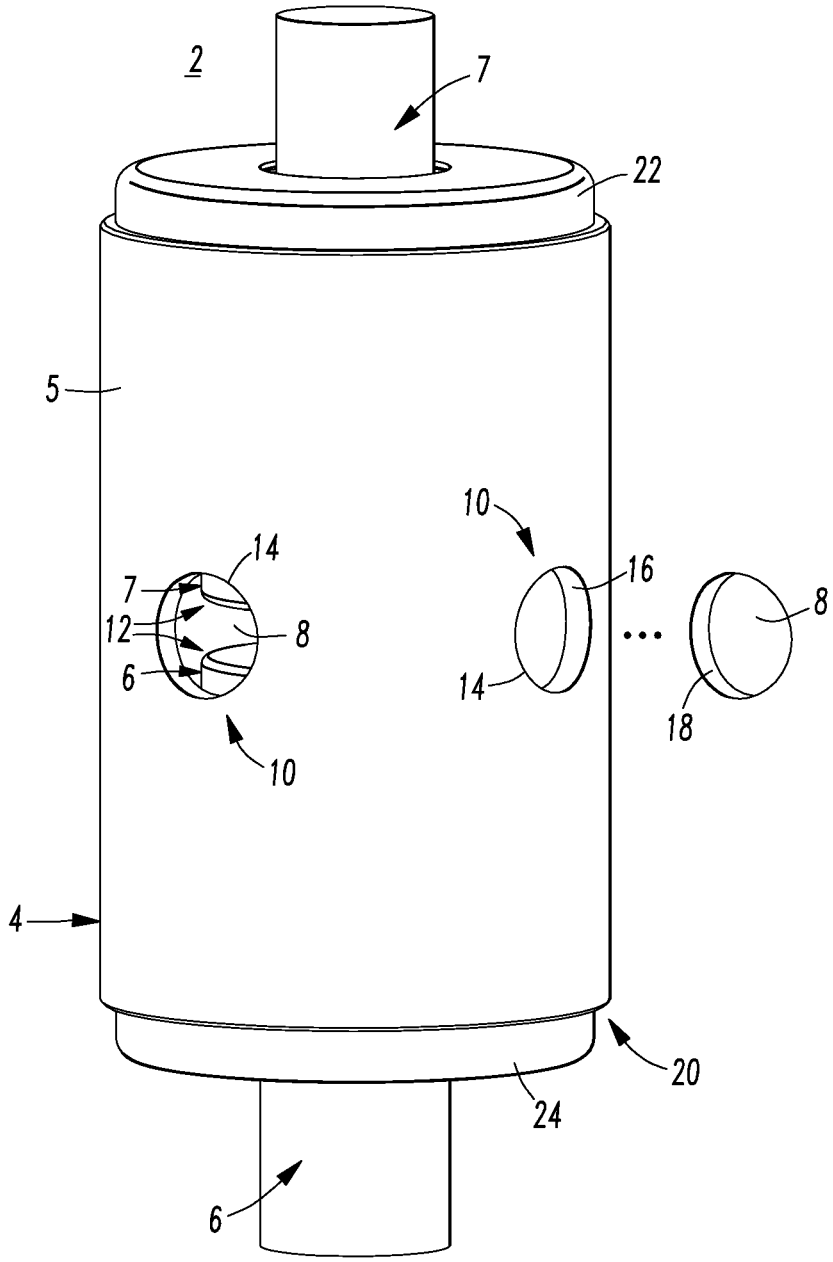
FIG. 1 is a partially exploded isometric view of a vacuum switch in an open position in accordance with embodiments of the disclosed concept.
Figure 2:
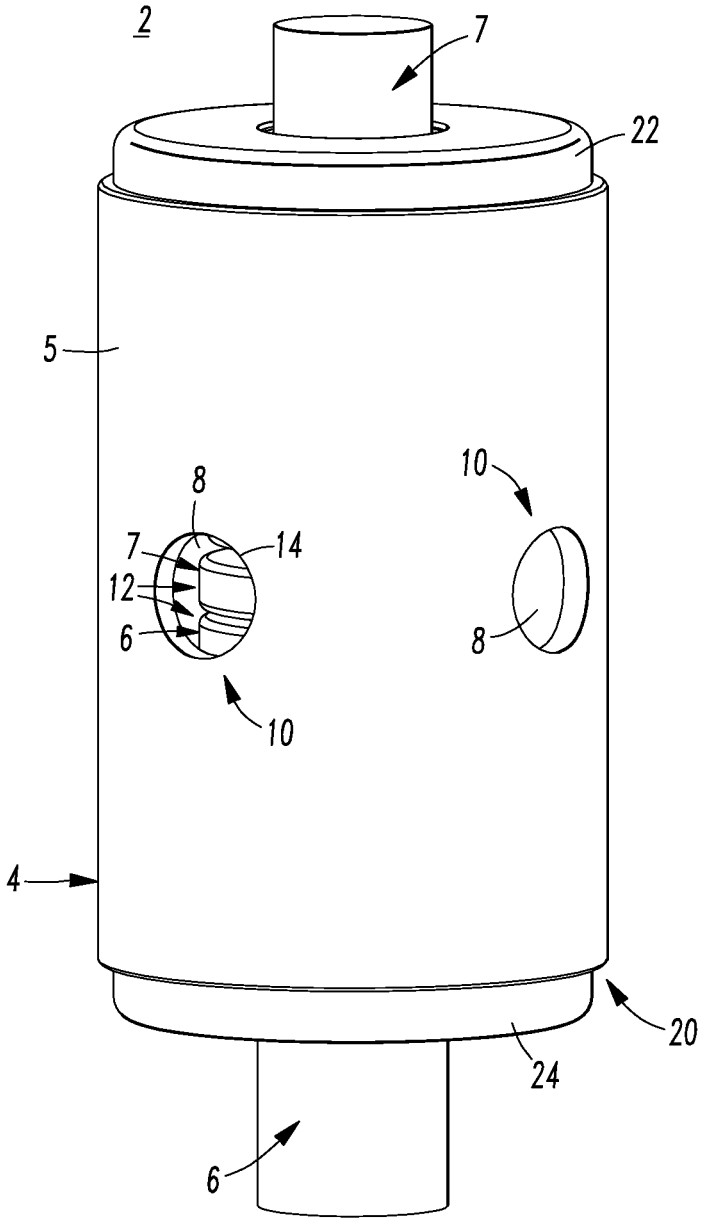
FIG. 2 is an isometric view of the vacuum switch of FIG. 1 in a closed position.

Referring to FIGS. 1 and 2, a vacuum switch, such as a vacuum interrupter 2, is shown. The vacuum switch 2 includes a vacuum envelope 4, a fixed contact assembly 6 partially within the vacuum envelope 4, and a movable contact assembly 7 partially within the vacuum envelope 4 and movable between a closed position (FIG. 2) in electrical contact with the fixed contact assembly 6 and an open position (FIG. 1) spaced apart from the fixed contact assembly 6. The vacuum envelope 4 is an insulating body including a number of transparent portions 8 (e.g., without limitation, two transparent portions 8 are shown in FIGS. 1 and 2) made of a single crystal alumina ($Al_2O_3$) (e.g., sapphire) for viewing the fixed contact assembly 6 and the movable contact assembly 7 within the vacuum envelope 4.

The insulating body 5 of the vacuum envelope 4 may be made of polycrystalline alumina ($Al_2O_3$).

The number of transparent portions 8 may be a number of sapphire members.

As shown in FIGS. 1 and 2, the transparent portions 8 are example transparent sapphire members (e.g., disks) brazed into the insulating body 5 of the vacuum envelope 4. This provides a number of viewing windows 10 for viewing the position of separable contacts 12 formed by the fixed contact assembly 6 and the movable contact assembly 7 in either the closed position (FIG. 2) or the open position (FIG. 1). Although example transparent sapphire disks are shown, the transparent portions 8 may have, for example and without limitation, any suitable shape, such as a rectangular shape and/or a curved surface for cosmetic reasons.

The insulating body 5 of the vacuum envelope 4 includes a number of openings 14. Each of the number of transparent portions 8 (e.g., number of sapphire members) is brazed to the insulating body 5 at a corresponding one of the number of openings 14.

The number of transparent portions 8 may be a number of transparent windows.

The insulating body 5 of the vacuum envelope 4 may be metalized at a number of edges 16. Each of the number of edges 16 may be defined by a corresponding one of the number of openings 14. Each of the number of transparent portions 8 may be metalized at a peripheral edge 18 corresponding to one of the metalized number of edges 16 of the insulating body. The metalized peripheral edge 18 may be brazed to a corresponding one of the metalized number of edges 16 of the insulating body 5.

During manufacture of the vacuum interrupter 2, interfacing regions (e.g., 16,18) of the vacuum envelope 4 are first metalized and then are brazed. The insulating body 5 is a cylinder 20 metalized at the interface areas, which are the number of edges 16. The number of transparent portions 8 (e.g., the number of transparent windows) are also metalized at the interface areas, which are the peripheral edges 18. The number of transparent windows and the cylinder 20 are brazed at the metalized areas. A pair of end members 22,24 are coupled at the ends of the cylinder 20 to complete the vacuum envelope 4.

In the disclosed embodiments, a vacuum is achieved internally with, for example, a vacuum furnace (not shown). The air is removed internally within the vacuum furnace and then the cylinder 20 and the number of transparent portions 8 are brazed together at the end of the vacuum cycle. The end result is a vacuum inside of the vacuum interrupter 2.

Figure 3:
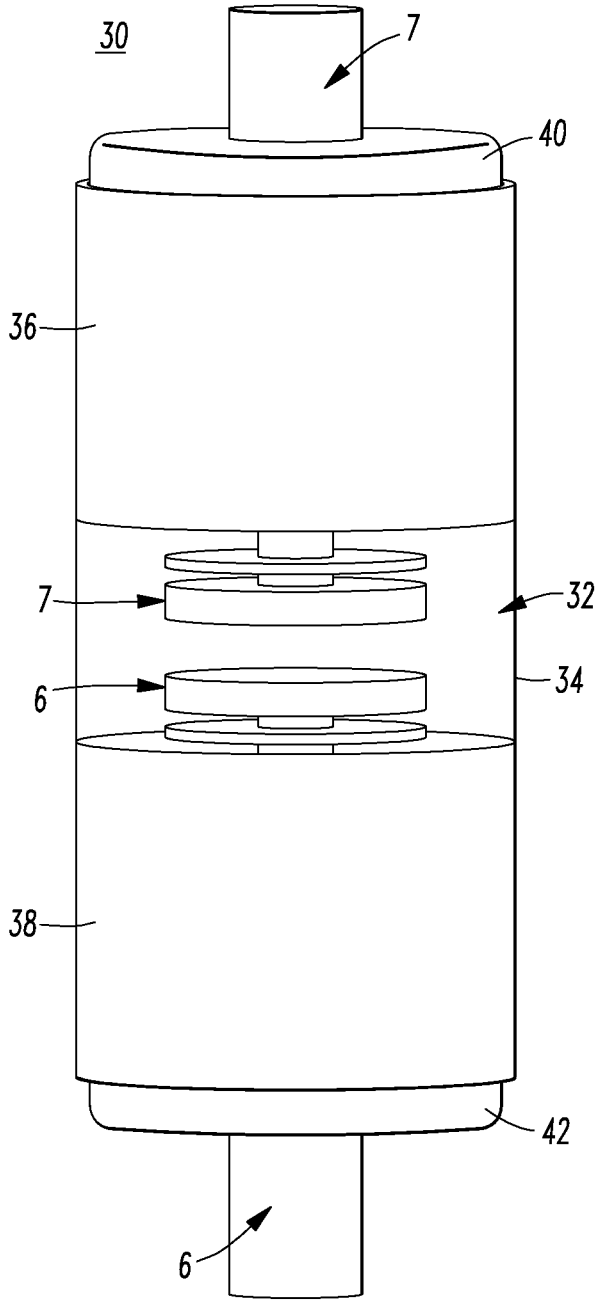
FIG. 3 is an isometric view of a vacuum switch in an open position in accordance with another embodiment of the disclosed concept.
Figure 4:
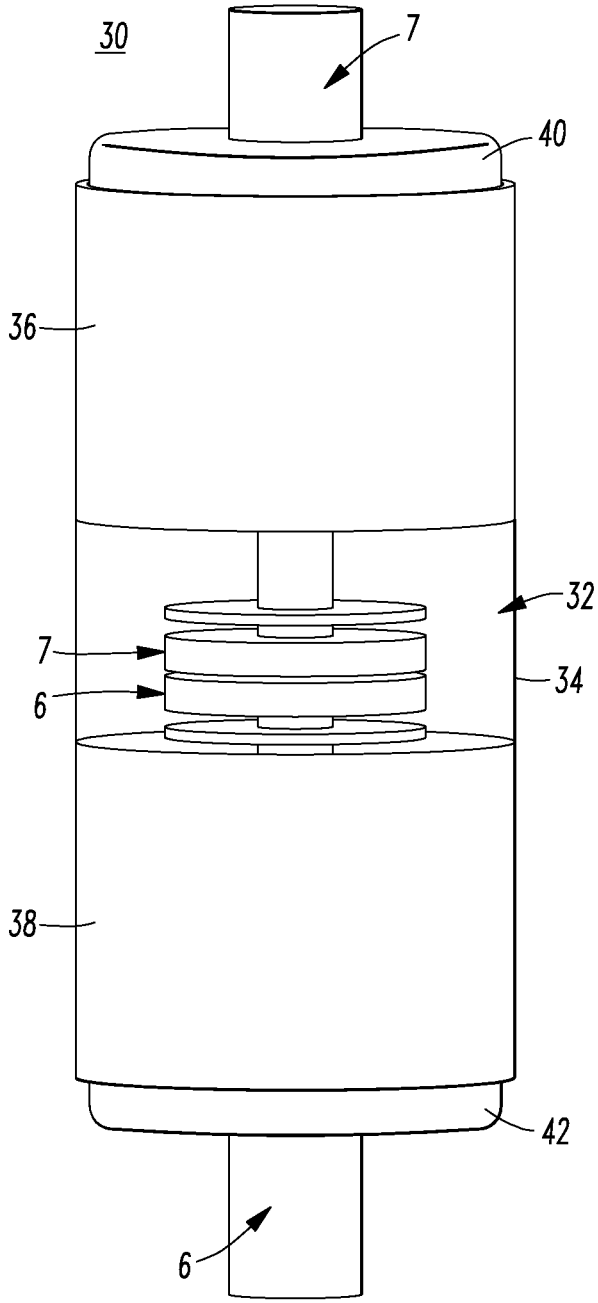
FIG. 4 is an isometric view of the vacuum switch of FIG. 3 in a closed position.

Referring to FIGS. 3 and 4, another vacuum switch, such as vacuum interrupter 30, is shown. The vacuum interrupter 30 is similar to the vacuum interrupter 2 of FIG. 1 except that a number of transparent portions (e.g., without limitation, one transparent portion 32 is shown in FIGS. 3 and 4) is a number of transparent regions 34, and an insulating body of a vacuum envelope of the example vacuum interrupter 30 is formed by a first upper (with respect to FIG. 3) cylinder 36 made of polycrystalline alumina ($Al_2O_3$), the central transparent region 34 made of single crystal alumina ($Al_2O_3$) (e.g., sapphire), and a second lower (with respect to FIG. 3) cylinder 38 made of polycrystalline alumina ($Al_2O_3$). A pair of end members 40,42 are coupled at the ends of the respective cylinders 36,38 to complete the vacuum envelope.

Figure 5:
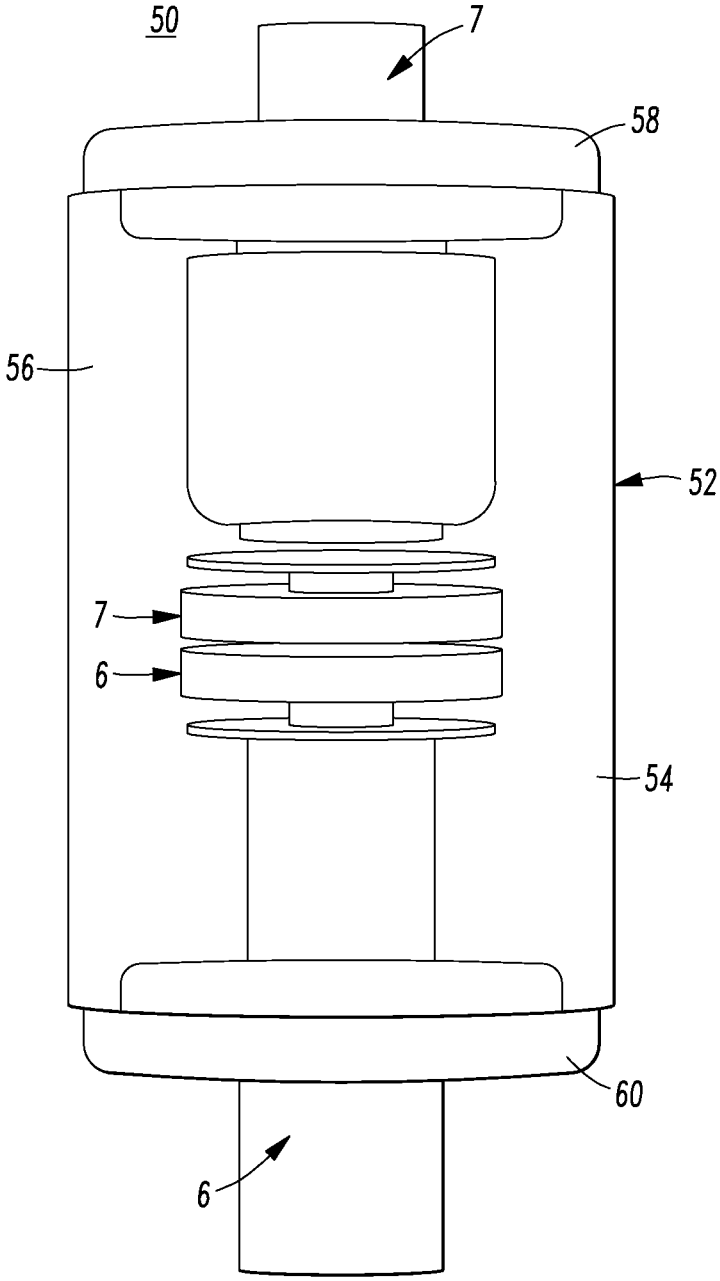
FIG. 5 is an isometric view of a vacuum switch in a closed position in accordance with another embodiment of the disclosed concept.

FIG. 5 shows another vacuum switch, such as vacuum interrupter 50, in a closed position. Here, the vacuum envelope 52 is an insulating body 54 that is a solid cylinder made of sapphire. For example and without limitation, a sapphire is a gemstone variety of the mineral corundum, an aluminium oxide ($Al_2O_3$). In this example, a number of transparent portions 56 is all of the insulating body 54. A pair of end members 58,60 are coupled at the ends of the insulating body 54 to complete the vacuum envelope.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A vacuum switch comprising:

a vacuum envelope;

a fixed contact assembly partially within said vacuum envelope; and a movable contact assembly partially within said vacuum envelope and movable between a closed position in electrical contact with the fixed contact assembly and an open position spaced apart from the fixed contact assembly;

wherein said vacuum envelope comprises an insulating body comprising a number of transparent portions made of a single crystal alumina for viewing said fixed contact assembly and said movable contact assembly within said vacuum envelope.

2. The vacuum switch of claim 1 wherein the insulating body further comprises a cylinder made of polycrystalline alumina.

3. The vacuum switch of claim 1 wherein said number of transparent portions is a number of sapphire members.

4. The vacuum switch of claim 3 wherein the insulating body further comprises a number of openings; and wherein each of said number of sapphire members is brazed to the insulating body at a corresponding one of the number of openings.

5. The vacuum switch of claim 1 wherein the insulating body is made of the single crystal alumina; and wherein said number of transparent portions is all of the insulating body.

6. The vacuum switch of claim 5 wherein the insulating body is in the form of a solid cylinder made of the single crystal alumina.

7. The vacuum switch of claim 1 wherein said number of transparent portions is a number of transparent windows.

8. The vacuum switch of claim 1 wherein said number of transparent portions is a number of transparent regions.

9. The vacuum switch of claim 1 wherein said number of transparent portions is all of the insulating body.

10. The vacuum switch of claim 1 wherein the insulating body further comprises a number of openings; and wherein each of said number of transparent portions is brazed to the insulating body at a corresponding one of the number of openings.

11. The vacuum switch of claim 10 wherein the insulating body is metalized at a number of edges; wherein each of said number of edges is defined by a corresponding one of the number of openings; wherein each of said number of transparent portions is metalized at a peripheral edge corresponding to one of the metalized number of edges of the insulating body; and wherein the metalized peripheral edge is brazed to a corresponding one of the metalized number of edges of the insulating body.

12. The vacuum switch of claim 1 wherein the vacuum switch is a vacuum interrupter.

13. The vacuum switch of claim 1 wherein the single crystal alumina is sapphire.

14. The vacuum switch of claim 1 wherein said number of transparent portions is a plurality of transparent portions.

15. The vacuum switch of claim 1 wherein said vacuum envelope further comprises a plurality of end members coupled to the insulating body.

* * * * *